US008283844B2

(12) United States Patent
Cho et al.

(10) Patent No.: US 8,283,844 B2
(45) Date of Patent: Oct. 9, 2012

(54) LIGHTING DEVICE

(75) Inventors: Hankyu Cho, Seoul (KR); Daehyuk Lee, Seoul (KR); Sanghyun Park, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 13/074,440

(22) Filed: Mar. 29, 2011

(65) Prior Publication Data

US 2011/0181167 A1 Jul. 28, 2011

(30) Foreign Application Priority Data

Jun. 23, 2010 (KR) ..... 10-2010-0059557

(51) Int. Cl.
*H01J 5/16* (2006.01)

(52) U.S. Cl. ..... 313/113; 362/299

(58) Field of Classification Search ..... 313/113, 313/111; 362/297–309
See application file for complete search history.

(56) References Cited

U.S. PATENT DOCUMENTS

| | | | | |
|---|---|---|---|---|
| 6,814,470 | B2 * | 11/2004 | Rizkin et al. | 362/327 |
| 7,349,163 | B2 * | 3/2008 | Angelini et al. | 359/708 |
| 7,473,013 | B2 * | 1/2009 | Shimada | 362/327 |
| 7,784,977 | B2 * | 8/2010 | Moolman et al. | 362/298 |
| 8,075,165 | B2 * | 12/2011 | Jiang et al. | 362/308 |
| 2003/0137838 | A1 * | 7/2003 | Rizkin et al. | 362/240 |
| 2003/0189826 | A1 * | 10/2003 | Yoon | 362/205 |
| 2004/0190299 | A1 * | 9/2004 | Chapman | 362/394 |
| 2007/0152230 | A1 * | 7/2007 | Duong et al. | 257/98 |
| 2010/0148688 | A1 * | 6/2010 | Hikmet et al. | 315/250 |

* cited by examiner

*Primary Examiner* — Nimeshkumar Patel
*Assistant Examiner* — Christopher Raabe
(74) *Attorney, Agent, or Firm* — KED & Associates, LLP

(57) ABSTRACT

A lighting device is disclosed herein. In the lighting device, a plurality of the light emitting elements may be provided based on a desired amount of light. The lighting device may include a reflector provided over the light emitting elements and a lens provided over the reflector. The reflector may be configured to reflect light emitted from the light emitting elements to reduce light loss and to improve light distribution efficiency in the lighting device.

20 Claims, 7 Drawing Sheets

LIGHTING DEVICE

CROSS-REFERENCE TO RELATED APPLICATION(S)

This application claims the benefit of the Patent Korean Application No. 10-2010-0059557, filed in Korea on Jun. 23, 2010, which is hereby incorporated by reference herein in its entirety.

BACKGROUND

1. Field

A lighting device is disclosed herein.

2. Background

Lighting devices are known. However, they suffer from various disadvantages.

BRIEF DESCRIPTION OF THE DRAWINGS

The embodiments will be described in detail with reference to the following drawings in which like reference numerals refer to like elements, wherein.

DETAILED DESCRIPTION

The present application or patent relates to a lighting device. The lighting device as embodied and broadly described herein may improve light distribution efficiency as well as assembly efficiency. In certain embodiments, a light emitting diode (LED) or LED devices may be used as a light source in the lighting device. The lighting device as disclosed herein allows a more efficient utilization and conservation of energy resources.

LEDs or LED devices may be semiconductor devices that produce light through carrier injection and recombination in a p-n junction of a semiconductor. Wavelengths of luminescent light, and corresponding color of the light, may vary based on a type of impurities which are added. For example, the luminescent light emitted by zinc and oxygen is red (wavelength of 700 nm), while the luminescent light emitted by nitrogen is green (wavelength of 550 nm). LEDs may have a more compact size, longer lifespan, higher efficiency, and higher response speeds when compared to conventional light sources, such as incandescent light sources.

An LED lighting device may be configured to emit diffused light or directional light depending on the desired application of the device. For example, if the LED lighting device is to provide general purpose lighting, an opaque diffusing cap may be provided to diffuse or remove the directionality in the emitted light. However, if the LED lighting device is to provide directional light, e.g., spot lighting, a light distributing lens structure may be provided to project the emitted light in a prescribed direction. The LED lighting device may include a photo-permeable lens to provide directionality to the emitted light. This lens may be configured to collect light emitted from an LED to project the light in a predetermined direction.

The LED lighting device may also include a reflector to improve the efficiency of the lighting device. For example, light emitted from the LED may be reflected or scattered by the lens or other surfaces inside the LED lighting device. The light may also be refracted at a surface of the lens to divert the light away from the intended direction, which may result in a loss of light. Loss of light in this manner may result in reduced efficiency of the light source including lower light intensity as well as unintended dispersion of the directional light. The reflector as embodied and broadly described herein may prevent such loss by redirecting the reflected or scattered light in the desired direction.

Simply for ease of discussion, the lighting emitting element is disclosed herein as an LED or LED element. However, the present disclosure is not limited thereto, and various types of light emitting elements may be applicable to the present disclosure. As embodied and broadly described herein, a light emitting element and a light emitting module may include any appropriate type of a light source that produces light when a voltage is applied thereto.

Figure 1:
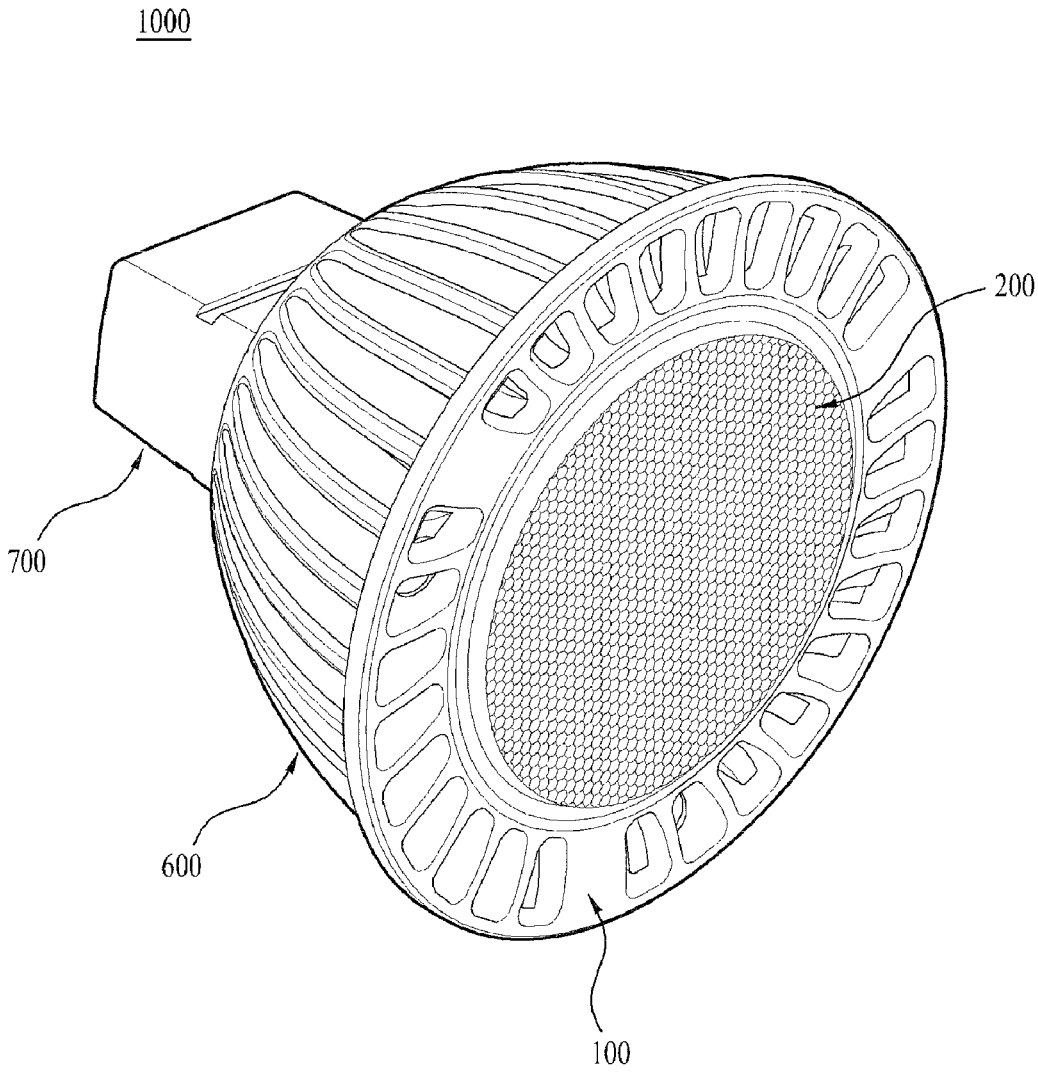
FIG. 1 is a perspective view of a lighting device according to an embodiment of the present disclosure.

FIG. 1 is a perspective view of a lighting device according to an embodiment of the present disclosure. Referring to FIG. 1, the lighting device 1000 according to this embodiment may include a lens 200 (lens member), a main body 600, a cover-ring 100 that may secure the lens 200 on the main body 600, and a base 700. The lighting device 1000 may also include an LED module (light source module) provided inside the main body 600 to generate light, as described in further detail with reference to FIG. 2 hereinbelow.

The lens 200 may be provided over the LED module to collect and distribute the light generated by the LED module. The lens 200 may be made of a photo-permeable material. Moreover, the lens 200 may be configured to provide directional or diffused light. The cover-ring 100 may be provided over the lens 200 and attached to the main body 600 to secure the lens 200 to the main body 600. The cover-ring 100 may be positioned to support an outer circumference of the lens 200.

The main body 600 may house or structurally support the various components of the lighting device 1000. Moreover, the main body 600 may be configured as a heat sink to dissipate heat generated by the LED module 400 provided therein. For example, the LED module may include a plurality of LEDs. When the LED module is mounted on a surface inside the main body 600, heat generated by the LEDs may be transferred to the main body 600. The main body 600 may be formed of a heat conducting material, such as metal, and may include radiator fins to improve heat dissipation characteristics of the heat sink. Simply for ease of discussion, the main body 600 is referred to hereinbelow as a heat sink.

A base 700 may be provided in a lower portion of the main body 600. The base 700 may include a housing and various electrical components that may control or power the lighting device 1000. For example, the base 700 may include an electrical control module 730 that may convert a high input voltage (e.g., commercial voltage) into an input voltage which is suitable for the LED module 400. The base 700 may also include a power socket configured to receive the high input voltage for supply to the electrical control module 730. The electrical control module 730 may be positioned inside the housing.

Figure 2:
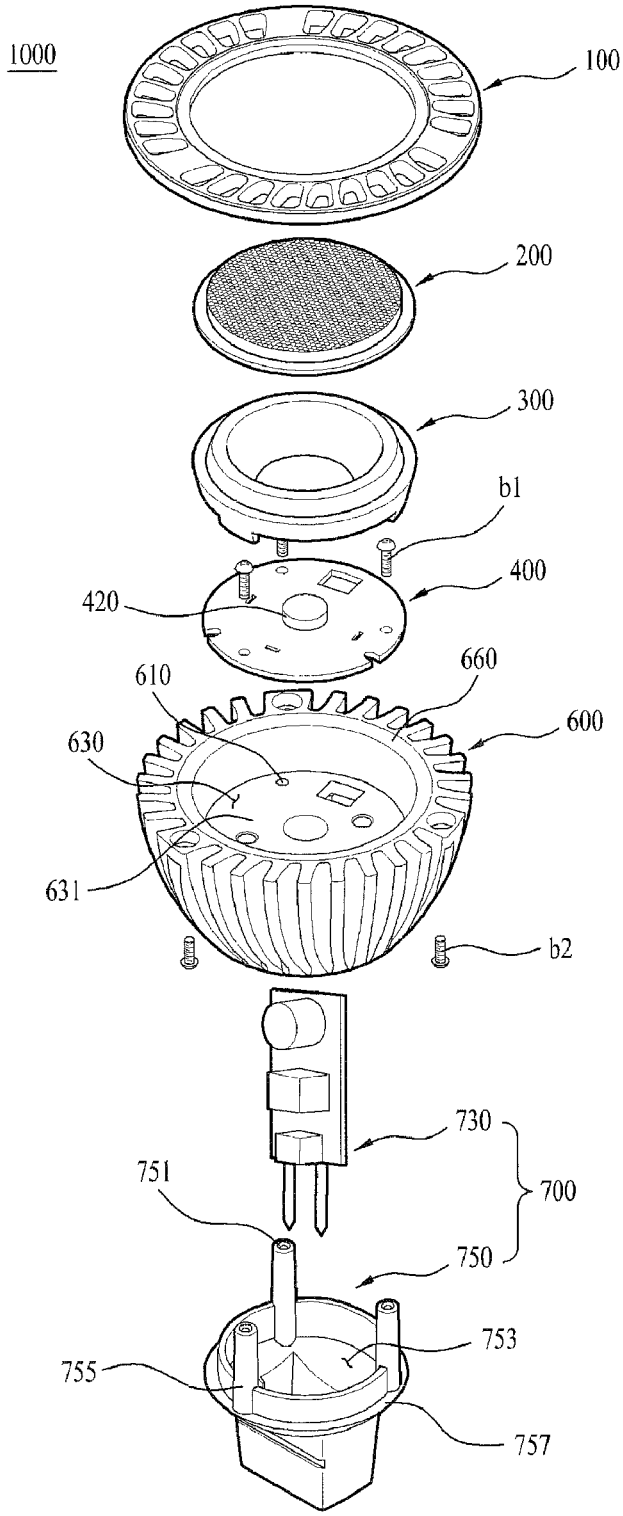
FIG. 2 is an exploded perspective view of the lighting device of FIG. 1.

FIG. 2 is an exploded perspective view of the lighting device of FIG. 1. Referring to FIG. 2, the LED module 400 may include one or more LEDs 420 and a substrate on which the plurality of the LEDs 420 may be mounted. The substrate may be formed of a metal material such that heat generated by the LEDs 420 may be quickly radiated away from the LEDs 420. The LED module 400 may be provided on a mounting surface inside the heat sink 600.

The lighting device 1000 may include a lens 200 provided over the LED module 400. The lens 200 may include a condensing lens 220 formed on a bottom surface thereof, as shown in FIG. 3. The condensing lens 220 may be formed to correspond to a position of the LED 420 on the LED module 400. The condensing lens 220 may be formed in a hemispherical or a cone shape to collect and project light emitted from the LEDs 420 in a predetermined direction. Moreover, the lens 200 may include a flange formed to correspond to a seating recess formed on the heat sink 600. The lens 200 may be mounted on the heat sink 600 such that the flange is seated on the seating recess of the heat sink 600. The lens 200, including the condensing lens 220, is described in further detail with reference to FIG. 3 hereinbelow.

The lighting device 1000 may include a reflector 300 (reflecting member) provided between the lens 200 and the LED module 400. The reflector 300 may be positioned in the heat sink 600 and formed to correspond to a shape of the lens 200. For example, the reflector 300 may include a plurality of reflecting surfaces which may be positioned adjacent to corresponding surfaces of the lens 200 such that light emitted from the LED module 400 may be reflected back towards the lens 200. The reflecting surfaces may surround the sloped side surface of the condensing lens 220 as well as surfaces of the lens 200 adjacent to the condensing lens 220. The reflector 300 is described in further detail with reference to FIGS. 4 and 5 hereinbelow.

The lighting device 1000 may include a main body configured as a heat sink 600. The heat sink 600 may be formed of a thermally conductive material, such as metal, to quickly dissipate heat generated by the LED module 400. The heat sink 600 may include an upper recess or cavity 630 (securing space) provided in the upper portion of the heat sink 600. The cavity 630 may include a mounting plate 631 on which the LED module 400 may be mounted. A lower recess or cavity 650 (inserting space) may be provided in a lower portion of the heat sink 600. The base 700 may be positioned in the lower recess 650. The mounting plate 631 may separate or divide the upper cavity 630 and the lower cavity 650 from each other in the heat sink 600.

In certain embodiments, a heat conduction pad 500 may be provided between the LED module 400 and the heat sink 600 to improve the thermal conductivity between the LED module 400 and the heat sink 600. The heat conduction pad 500 may maximize heat transfer between the LED module 400 and the heat sink 600 by increasing the contact area between the LED module 400 and the heat sink 600. For example, the heat conduction pad 500 may be formed of a flexible material that increases the contact area.

In certain embodiments, a heat sink compound may be applied between the heat sink 600 and the LED module 400 to improve thermal conductivity. The heat sink compound may be formed a material having a high thermal conductivity. Moreover, the heat sink compound may also be an adhesive that may secure the LED module 400 to the mounting surface 631 inside the cavity 630. It should be appreciated that the heat conduction pad 500 may also include adhesive material on both surfaces thereof to attach the LED module 400 to the heat sink 600.

The base 700 may include the electrical control module 730 and a housing 750. The electrical control module 730 may be configured to convert a commercial voltage into a voltage compatible with the LED module 400. The housing 750 may be configured to house a portion of the electrical control module 730. For example, the housing 750 may include a cavity 753 (accommodating space) formed therein and configured such that the electrical control module 730 may be seated in the housing cavity 753.

The housing 750 may include at least one coupling boss 751 formed in an upper end thereof to be coupled to the LED module 400. The coupling boss 751 may be directly coupled with the LED module 400 by a connector b1 (coupling member). A coupling hole 610 may be provided through the mounting plate 631 in the heat sink 600. The connector b1 may be connected to the coupling boss 751 through the coupling hole 610. Moreover, a bottom surface of the mounting plate 631 in the lower cavity 650 may include a recess formed around the coupling hole 610 to receive the coupling boss 751 therein.

In certain embodiments, the coupling hole 610 may be formed to have a diameter or width that is greater than or equal to a width of the coupling boss 751 such that the coupling boss 751 may pass through the coupling hole 610. In this case, the base 700 may be connected directly to the LED module 400 such that the connector b1 and the LED module 400 may be electrically isolated from the heat sink 600. For example, if the LED module 400 includes a large number of LEDs 420, the top surface of the metal substrate may become crowded. Hence, faulty solder joints or the like during assembly of the lighting device may occur and may cause the metal substrate to be electrically connected to the connector b1. To prevent possible electrical shorts between the connector b1 and the heat sink 600, the coupling boss 751 may be directly connected to the LED module 400 to bypass the heat sink 600.

The housing 750 may also include a guide rib 755 and guide groove 651 which may facilitate assembly of the base 700 with the heat sink 600. A guide rib 755 may be provided on an outer side surface of the housing 750 to guide the insertion of the base 700 into the lower cavity 650 of the heat sink 600. In addition, a guide groove 651 may be provided on an inner side surface of the lower cavity 650 in the heat sink 600. The guide groove 651 may be positioned to correspond to a position of the guide rib 755 such that the guide rib 755 is seated in the guide rib 755 to guide the base 700 during insertion. Moreover, the coupling boss 751 may be formed integrally to a distal end of the guide rib 755.

The configuration of the guide rib 755 and the guide groove 651 may be reversed. For example, the guide rib 755 may be provided on the heat sink 600 and the guide ribs may be provided on the base 700. Moreover, the number and positions of the guide rib 755 and guide groove 651 may be variable. For example, if more than one pair of guide rib 755 and guide groove 651 are provided, each pair of the guides may be spaced at different intervals such that an orientation of the base 700 may be fixed. In other words, the base 700 may be keyed to the lower cavity 650 by the guide rib 755 and guide groove 651.

In another embodiment, the coupling boss 751 may be replaced with a connector such as screw threads, a hook/notch type connector, or another appropriate type of connector. Screw threads, for example, may be provided on an upper-outer surface of the housing 750 and configured to mate to corresponding screw threads provided inside the lower cavity 650 in the heat sink 600. In this embodiment, base 700 and the LED module 400 may be connected to the heat sink 600 without connector 131. For example, the LED module 400 may be mounted to the heat sink 600 using, for example, an adhesive as previously described. Hence, if the base 700 is mounted to the heat sink 600 using screw threads, or the like, formed integrally thereon, both the base 700 and the LED module 400 may be connected without connectors b1.

Figure 6:
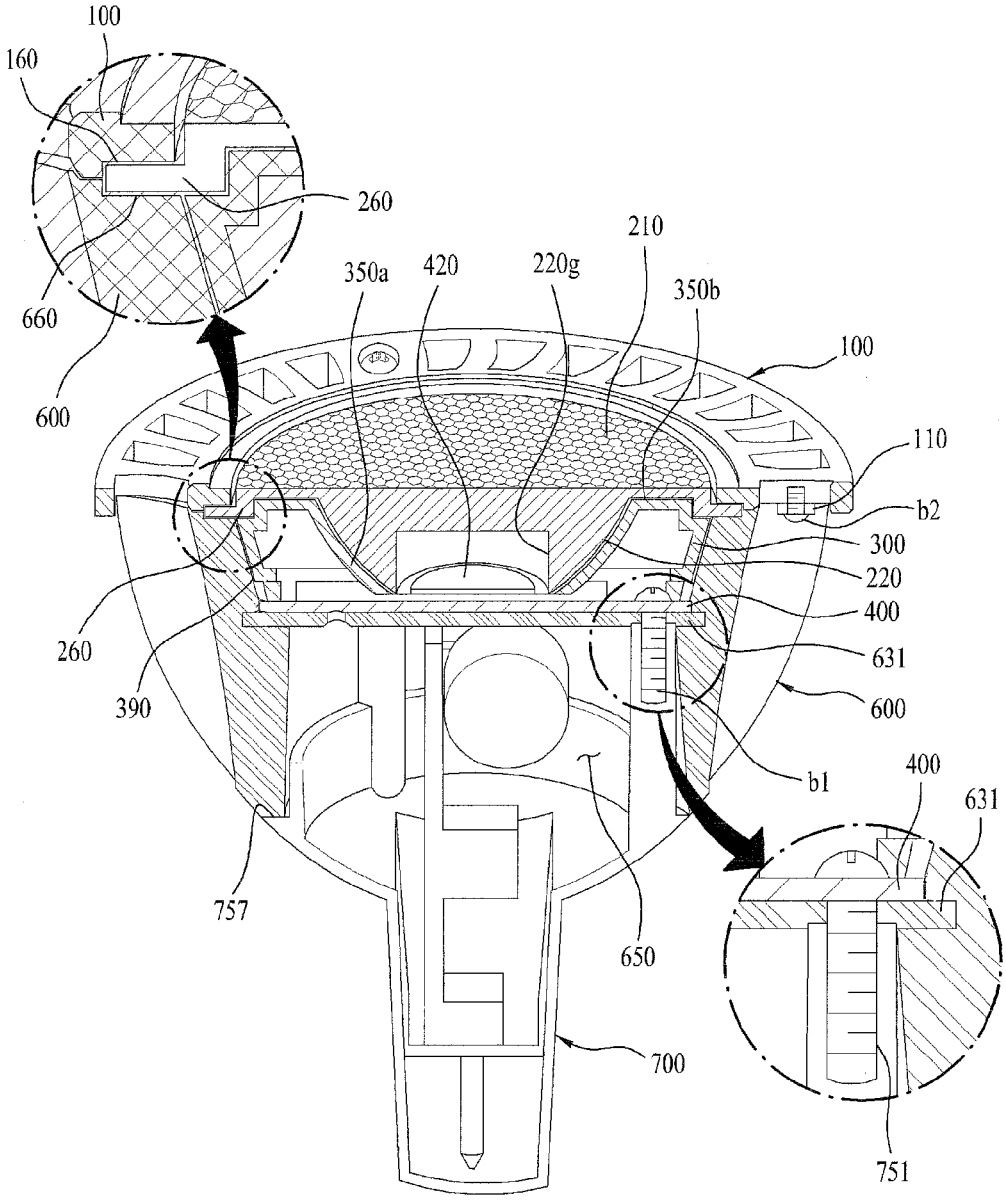
FIG. 6 is a cross-sectional view of the lighting device according to an embodiment of the present disclosure.

Referring again to FIG. 2, a hooking protrusion 757 may be provided on an outer side surface of the housing 750. The hooking protrusion 757 may be configured to limit an insertion depth of the housing 750 into the lower cavity 650 of the heat sink 600. The insertion depth of the housing 750 may be limited because the hooking protrusion 757 may be hooked to the lower end of the heat sink 600. As shown in FIG. 2, hooking protrusion 757 may be formed as a ledge or step that protrudes from a side surface of the housing 750. The hooking protrusion 757 may be formed around the outer circumference of the housing 750 and formed to correspond to a lower circumferential edge of the heat sink 600, as shown in FIG. 6.

The base 700 may also include the electrical control module 730. The electrical control module 730 may be provided in the cavity 753 formed in the housing 750. The electrical control module 730 may include an AC-DC converter configured to convert an alternative current (AC) into a direct current (DC). The electrical control module 730 may be connected to the LED module 400 via a connecting hole 620 formed in the heat sink 600. An electrode socket or plug may be provided in a lower portion of the base 700 to supply to the electrical control module 730. The electrode socket 780 may be mated to a corresponding external socket or plug to receive power.

As disclosed herein, the LED module 400 may be secured to both the heat sink 600 and the base 700 by connector b1. The heat conduction pad 500 may be provided between the heat sink 600 and the LED module 400 to conduct the heat generated by the LED module 400 to the heat sink 600. Hence, a number of connectors b1 necessary to assemble the lighting device may be reduced. Moreover, in certain embodiments, the LED module 400 and base 700 may be connected to the heat sink 600 without the use of connector b1.

Figure 3A:
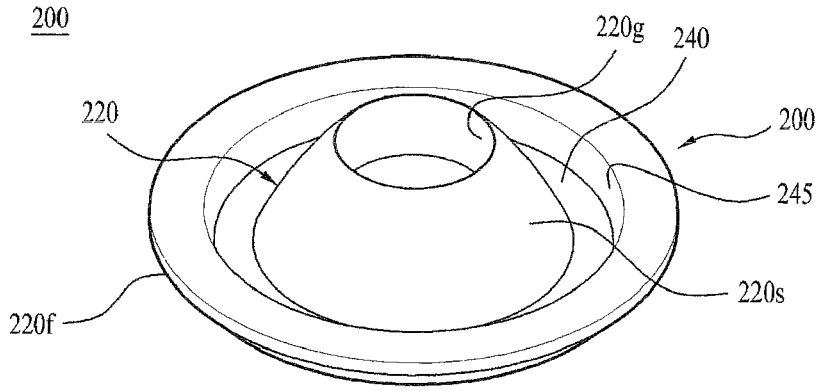
FIGS. 3A-3C are perspective and cross-sectional views of a lens according to the present disclosure.
Figure 3B:
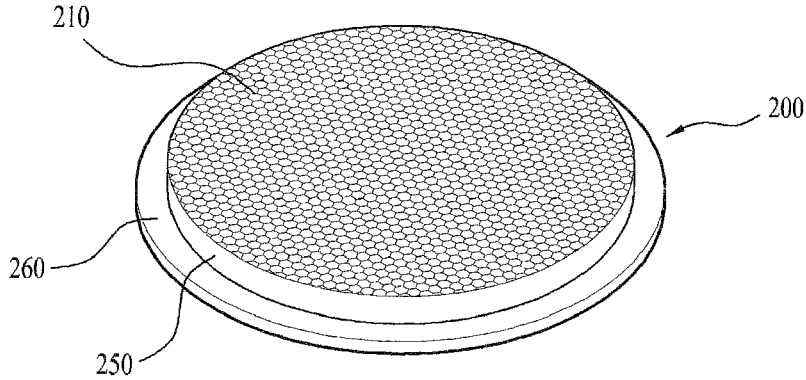
Figure 3C:
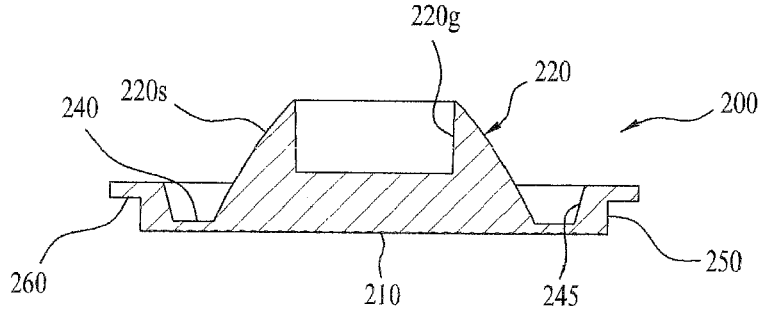

FIGS. 3A-3C are perspective and cross-sectional views of a lens of the lighting device according to the present disclosure. Specifically, FIG. 3A is a perspective view of a bottom surface (back surface) of the lens 200, FIG. 3B is a perspective view of the top surface (front surface) of the lens 200, and FIG. 3C is a cross-sectional view of the lens 200.

The lens 200 may be made of photo-permeable material and the top surface of the lens 200 may be a light exit surface 210 (a light projection surface). The light exit surface 210 may include a micro lens array. The micro lens array may be an arrangement of micro lenses positioned on the light projection surface 210. The micro lens array may improve a light distribution efficiency and quality of the light projected from the lens 200.

Referring to FIG. 3A, the lens 200 may include a condensing lens 220 (collecting lens) provided on a bottom surface of the lens 200 which is opposite to the light exit surface 210. The condensing lens 220 may collect light emitted from the LEDs 420 of the LED module 400 to project the light with a predetermined directionality. If the LEDs 420 are mounted in a center portion of the LED module 400, the condensing lens 220 may also be provided in a center portion of the bottom surface of the lens 200.

The lens 200 may also include a window region 240 (window part) adjacent to the condensing lens 220. The window region 240 may surround an outer circumference of the condensing lens 220. As the condensing lens 220 may be positioned to correspond to the LEDs 420, light emitted from the LEDs 420 may not be directly incident on the lens 200 at the window region 240. However, when the light emitted from the LEDs 420 reaches a surface of the condensing lens 220, it may be reflected or scattered inside the condensing lens 220 and directed into the window region 240. This scattered light may be lost if not reflected back towards the light exit surface 210. Hence, the reflector 300 may include a reflecting surface positioned adjacent to the window region 240 that redirects or reflects the scattered light toward the light exit surface 210, as described in further detail with reference to FIGS. 4 and 5 hereinbelow.

Referring to FIG. 3C, a recess 220*g* (recessed portion) may be provided at an end of the condensing lens 220. The recess 220*g* may be positioned to correspond to the LED 420 provided in the LED module 400 such that the light emitted from the LED 420 may be directed inside the recess 220*g*. The condensing lens 220 may include a sloped side surface 220*s* formed around the recess 220*g*. The sloped side surface 990*s* of the condensing lens 990 may have a prescribed curvature. The condensing lens 220 may have various shapes such that light incident on the recess 220*g* may be reflected by the sloped side surface 220*s* to improve the light distributing efficiency. For example, the condensing lens 220 may be hemispherical, dome shaped, cone shaped, or another appropriate shape. Moreover, the amount of curvature or incline of the side surfaces of the condensing lens 220 may be varied based on the desired characteristics of the emitted light.

The lens 200 may include a coupling flange 260 (securing flange). The coupling flange 260 may be formed around a circumference of the window region 240. As shown in FIG. 6, a cover-ring 100 may be provided to secure the lens 200 at the coupling flange 260 to the heat sink 600. The cover-ring 100 may be shaped to correspond to the coupling flange 260 to secure the outer edges of the lens 200 to the heat sink 600. The cover-ring 100 may be coupled to the heat sink 600 by a connector b2 (coupling member) from a rear direction, e.g. through the heat sink 600 and into the cover-ring 100, such that the connector b2 is not visible on the cover-ring 100. It should be appreciated that connector b2 may also be positioned through the top of the cover-ring 100.

The coupling flange 260 may include a step 250. The coupling flange 260 may be stepped down via step 250 in the direction in which the condensing lens 220 protrudes, as shown in FIG. 3C. The coupling flange 260 may also be formed to be parallel to the window region 240. In other words, the coupling flange 260 may be positioned a prescribed distance below the light exit surface 210 of the lens 200, and formed to protrude outward from a side surface of the lens, e.g. step 250. The step 250 may have a height that corresponds to a thickness of the cover-ring 100 such that the top surface of the cover-ring 100 and the light exit surface 210 may be substantially coplanar. Accordingly, the overall height of the lighting device 1000 may be minimized.

Moreover, when the lens 200 is seated on the heat sink 600, the coupling flange 260 may be seated on a seating recess 660 formed on the heat sink 600. The seating recess 660 may be formed around the circumference of the cavity 630. As shown in FIG. 6, a height of the seating recess 660 may be less than a thickness of the coupling flange 260. Moreover, the cover-ring 100 may include a coupling recess 160 formed on a bottom surface of the cover-ring 100. The coupling recess 160 may be formed to correspond to a shape of the coupling flange 260 and may have a height less than a thickness of the coupling flange 260. The height of the seating recess 660 together with the height of the coupling recess 160 may be equal to the height of the coupling flange 260. Hence, when the lens 200 and the cover-ring 100 are assembled on the heat sink 600, the coupling flange 260 of the lens 200 may be secured between the heat sink 600 and the cover-ring 100.

Figure 4A:
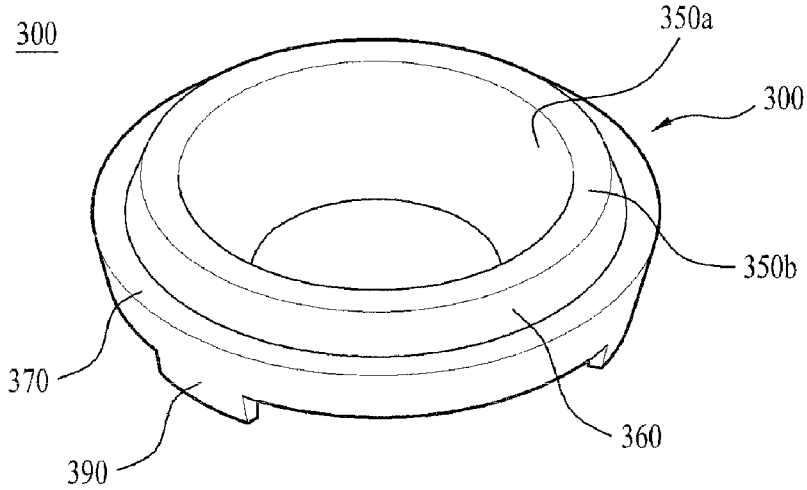
FIGS. 4A and 4B are perspective and cross-sectional views of a reflector according to an embodiment of the present disclosure.
Figure 4B:
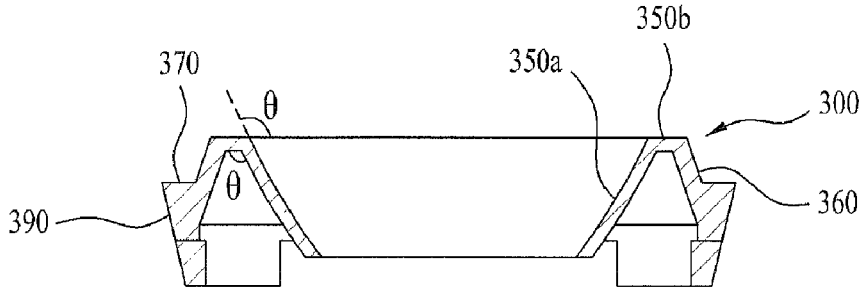

FIGS. 4A and 4B are perspective and cross-sectional views of the reflector provided in the lighting device according to the present disclosure. Specifically, FIG. 4A is a perspective of the reflector 300 and FIG. 4B is a cross-sectional view of the reflector 300. As described hereinbelow, the reflector 300 (reflecting member) may have a reflecting surface shaped to correspond to a shape of the lens 200 such that light emission characteristics of the lighting device 1000 may be improved.

The reflector 300 may be provided over the LED module 400. The reflector 300 may be positioned between the light emitting module 400 and the lens 200. A surface of the reflector 300 may be shaped to correspond to a shape of the lens 200. For example, the reflector 300 may include a first and second reflecting surfaces 350*a*, 350*b* (first and second reflecting sides). The first reflecting surface 350*a* may be inclined at a prescribed angle and shaped to correspond to a shape of the condensing lens 220 such that the first reflecting surface 350*a* surrounds the sloped side surface 220*s* of the condensing lens 220. The second reflecting surface 350*b* may be provided adjacent to the first reflecting surface 350*a* and may be formed to be inclined at an angle that is different than the angle of the first reflecting surface 350*a*. The second reflecting surface 350*b* may be formed to correspond to a shape of the window region 240 on the lens 200.

The first reflecting surface 350*a* may have a pipe structure having an inner diameter that gradually increases. For example, the reflector 300 at the first reflecting surface 350*a* may have an inverted cone shape. The first reflecting surface 350*a* may also be curved along the vertical direction. An angle of incline of the first reflecting surface 350*a* may correspond to an angle of incline of the sloped side surface 220*s* of the condensing lens 220. To improve reflectivity of the reflector 300, the first reflecting surface 350*a* may be positioned adjacent to the sloped side surface 220*s* of the condensing lens 220. For example, the first reflecting surface 350*a* of the reflector 300 may be in direct contact with the sloped side surface 220*s* of the condensing lens 220.

In certain embodiments, the first reflecting surface 350*a* may be positioned a prescribed distance from the sloped side surface 220*s*. If the spacing between the two surfaces is greater than a predefined tolerance light may be scattered and refracted between the lens 200 and the reflector 300. In this case, light may be lost and the efficiency of the lighting device 1000 may be diminished. Accordingly, the first reflecting surface 350*a* is positioned adjacent to the sloped side surface 220*s* of the condensing lens 220 within the predefined tolerance. Moreover, to increase the optical performance of the lighting device 1000, an inner diameter of the first reflecting surface 350*a* and an outer diameter of the sloped side surface 220*s* may be provided to correspond to each other such that the first reflecting surface 350*a* of the reflector 300 and the sloped side surface 220*s* of the condensing lens 220 are in contact with each other or within a gap within a predefined tolerance.

Moreover, the shape of the first reflecting surface 350*a* may be formed to correspond to the shape of the condensing lens 220. Simply for ease of discussion, the condensing lens is described herein as having a curved side surface, e.g., a hemispherical shape. However, this disclosure is not limited thereto and the condensing lens 220 may have linear side surfaces. For example, the condensing lens 220 may have a cone shape or another appropriate shape based on the desired characteristic of the emitted light. Moreover, the curvature of the first reflecting surface 350*a* may be varied.

The reflector 300 may further include a second reflecting surface 350*b* positioned adjacent to the first reflecting surface 350. The second reflecting surface 350*b* may be formed to extend from the first reflecting surface 350*a*, or bent therefrom, and inclined at a second angle. The second reflecting surface 350*b* may have a predetermined inclination different from the inclination of the first reflecting surface 350*a*. As shown in FIG. 4B, angle θ is an angle formed between the first and second surfaces measured from the outer surfaces of the reflector 300. The angle θ formed between the first reflecting surface 350*a* and the second reflecting surface 350*b* may be 90° or greater. In other words, when measured from the interior reflecting surfaces, the angle θ may be 270° or less. In certain embodiments, the angle θ may be 100° or greater (260° or less) such that the second reflecting surface 350*b* is inclined more towards the center of the lens 200 and the light scattered or reflected away from the condensing lens 220 may be more effectively redirected by the second reflecting surface 350*b* back towards the light exit surface 210 of the lens 200.

The reflector 300 provided in the lighting device 1000 according to the present disclosure may include a coupling surface 370 (hooking protrusion) that may provide support for the coupling flange 260 of the lens 200. The coupling surface 370 may include a step 360 formed around a circumference of the second reflecting surface 350*b* of the reflector 300.

The coupling surface 370 may be formed to correspond to a bottom surface of the coupling flange 260 when the lens 200 is positioned over the reflector 300. For example, when the reflector 300 and the lens 200 are assembled, the coupling flange 260 may be seated on the coupling surface 370. A height of the step 360 provided on the reflector may correspond to a height of the step 245 provided on the lens 200. Moreover, when the coupling flange 260 is seated on the coupling surface 370, the second reflecting surface 350*b* of the reflector 300 may be positioned adjacent to the window region 240 of the lens 200, as shown in FIG. 6.

Specifically, the lens 200 may include the window region 240 provided around the condensing lens 220. The window region 240 may be a surface inside a recess formed around the circumference of the condensing lens 200, as shown in FIGS. 3A and 3C. The recess may be formed by the side surface 220*s* of the condensing lens 220, window region 240, and the step 245. When the lens 200 and reflector 300 are assembled, the second reflecting surface 350*b* of the reflector 300 may extend to a surface inside the recess, e.g., the window region 240. The second reflecting surface 350*b* of the reflector 300 may be configured to make direct contact with the window region 240. Moreover, the angle of the second reflecting surface 350*b* may be the same as the angle of the window region 240 such that the entire surface area of second reflecting surface 350*b* may be in direct contact with the window region 240.

Moreover, the step 360 of the reflector 300 may be positioned adjacent to the step 245 on the lens 200. The step 360 on the reflector 300 may have a predetermined height that corresponds to the height of the step 245 on the lens 200. Hence, when the lens 200 and the reflector 300 are assembled, the surfaces of lens 200 (the sloped side surface 220*s*, the window region 240, the step 245, and a surface on the coupling flange 260) may be positioned at a prescribed distance from, or in direct contact with, the corresponding surfaces of the reflector 300 (the first reflecting surface 350*a*, the second reflecting surface 350*b*, the step 360, and the coupling surface 370).

The second reflecting surface 350*b* of the reflector 300 may be configured to reflect light which may be scattered along the window region 240 back toward the light emitting surface of the lens 200. For example, light which is scattered or reflected away from the condensing lens 220 may escape through the window region 240 of the lens 200. In other words, because the first reflecting surface 350*a* is positioned adjacent to the condensing lens 220, bulk of the light emitted from the LED 420 is reflected inside the condensing lens 220. However, a portion of the light may be reflected, for example, from the light exit surface 210 of the lens 200 back into the lens 200. This scattered light may escape through a gap at the window region 240. However, because the second reflecting surface 350*b* may be positioned adjacent to the window region 240, the scattered light may be redirected by the second reflecting surface 350*b* back towards the light exit surface 210 of lens 200.

In this embodiment, as previously described, the first reflecting surface 350*a* may be inclined at a first prescribed angle that corresponds to an angle of incline of the sloped side surface 220*s* of the condensing lens 220. The second reflecting surface 350*b* may be positioned adjacent to the first reflecting surface 350*a* and formed to extend at a second prescribed angle from the first reflecting surface 350*a*. The second reflecting surface 350*b* may be inclined to correspond to the shape of the window region 240 on the bottom surface of the lens 200. The second reflecting surface 350*b* of the reflector 300 may be parallel to the window region 240 of the lens 200 such that it may be positioned to make contact with the window region 240.

Figure 5A:
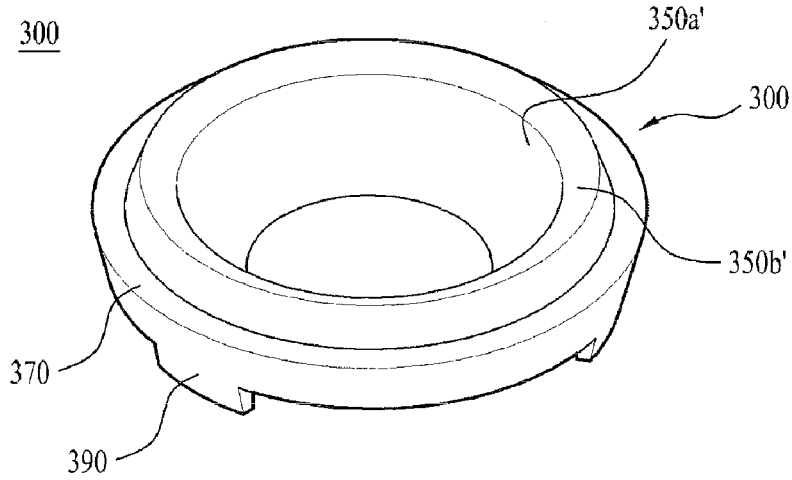
FIGS. 5A and 5B are perspective and cross-sectional views of a reflector according to another embodiment of the present disclosure.
Figure 5B:
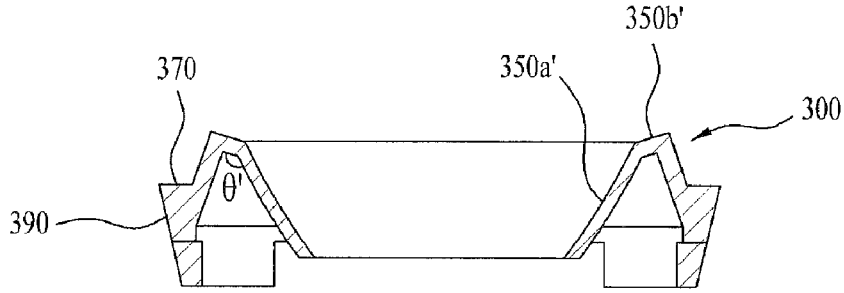

FIGS. 5A and 5B are perspective and cross-sectional views of a reflector according to another embodiment of the present disclosure. The reflector of this embodiment includes features which are similar to the features previously described with reference to FIG. 4. Hence, detailed description of features previously described are omitted hereinbelow.

Referring to FIGS. 5A and 5B, the reflector 300 of this embodiment may include a first reflecting surface 350*a*' and a second reflecting surface 350*b*'. Similar to the previously described embodiment of FIG. 4, the first reflecting surface 350*a*' may have a predetermined inclination which corresponds to an inclination of the sloped side surface 220*s* of the condensing lens 220. In this embodiment, however, an angle θ' formed between the first reflecting surface 350*a*' and the second reflecting surface 350*b*' may be greater than the angle θ formed between the first and second reflecting surfaces 350*a* and 350*b*, as previously described with respect to FIG. 4.

In other words, the second reflecting surface 350*b*' of this embodiment may be inclined at a greater angle than in the previous embodiment. Because the surface in the window region 240 may be substantially parallel to the light exit surface 210, the second reflecting surface 350*b*' which is inclined at the greater angle θ' may not be parallel to the window region 240. Therefore, the entire surface of the second reflecting surface 350*b*' may not be in direct contact with the window region 240. Here, only an upper end of the second reflecting surface 350*b*' may be in contact with the window region 240, e.g., the end of the second reflecting surface 350*b*' closest to the outer circumference of the reflector 300. When this outer edge of the second reflecting surface 350*b*' is extended to touch the window region 240 of the lens 200, scattered light escaping the condensing lens 220 may be redirected toward the light exit surface 210. As the angle θ' formed between the first reflecting surface 350*a*' and the second reflecting surface 350*b*' is increased, the second reflecting surface 350*b*' may more effectively reflect light back toward the center of the lens 200. Accordingly, light distribution efficiency of the lighting device 1000 may be improved.

In another embodiment, the surface of the window region 240 may be inclined at a predetermined angle. This predetermined angle may be the same as the angle of incline of the second reflecting surface 350*b*'. In this case, the window region 240 and the second reflecting surface 350*b*' may be parallel to each other, and thus, may be positioned to be in direct contact with each other. Because both the reflecting surface 350*b*' and the window region 240 are angled towards the center of the lens 200, light escaping the condensing lens 220 may be reflected back to be emitted at the light exit surface 210.

It should be appreciated that the window region 240 and the second reflecting surface 350*b*' may be inclined at different angles. In this case, the outer edge of the second reflecting surface 350*b*' may be positioned adjacent to or in direct contact with the window region 240. When the outer edge of the second reflecting surface 350*b*' is in direct contact with the window region 240, loss of light through a gap near the window region 240 may be minimized. Moreover, it should be appreciated that window region 240 and the second reflecting surface 350*b*' may be positioned at a predetermined distance from each other. This distance between the lens 200 and the reflector 300 may be determined based on factors such as light emission efficiency, manufacturing tolerances, and the like.

Simply for ease of discussion, the window region 240 and the second reflecting surface 350*b*, 350*b*' are disclosed herein as being a linear surface. However, the embodiments as disclosed herein are not limited thereto. For example, the second reflecting surface 350*b*, 350*b*' may be curved to have a concave shape. The shape of the reflecting surface 350*b*, 350*b*' may be formed similar to a shape of the first reflecting surface 350*a*. Moreover, the window region 240 may be shaped to correspond to a shape of the second reflecting surface 350*b*, 350*b*'.

FIG. 6 is a sectional view of the lighting device according to the present disclosure. A description of features in this embodiment which were previously described with reference to FIGS. 1 to 5 are omitted hereinbelow. In this embodiment, the lens 200 may include the condensing lens 220 having a recess 220*g* provided in a center portion of the condensing lens 220 and a sloped side surface 220*s* formed around the recess 220*g*. The condensing lens 220 may be configured to collect and project light emitted from the LED 420 in a predefined direction through the light exit surface of the lens 200.

A portion of light emitted from the LED 420 may be refracted or reflected from a surface the condensing lens 220 and scattered within the lighting device 1000. This scattered light may be reflected back into the condensing lens 220 by the first reflecting surface 350*a* of the reflector 300. To improve the performance of the reflector 300, the first reflecting surface 350*a* may be shaped to correspond to a shape of the condensing lens 220. For example, an angle of incline of the first reflecting surface 350*a* may be the same as the angle of incline of the side surface 220*s* of the condensing lens 220.

The lens 200 may include a window region 240 formed around a circumference of the condensing lens 220. While a majority of the light may be reflected back into the condensing lens 220 or emitted through the light exit surface 210, a portion of the light may be scattered to escape through a gap formed near the window region 240. The reflector 300 may include a second reflecting surface 350*b* provided adjacent to the first reflecting surface 350*a*. The second reflecting surface 350*a* may be formed to be extended and bent from the first reflecting surface 350*a*.

The second reflecting surface 350*b* may be positioned adjacent to the window region 240 to reflect the scattered light escaping near the window region 240. To improve the performance of the reflector 300, the second reflecting surface 350*b* may formed parallel to the window region 240 such that the two surfaces may be in direct contact with each other. Moreover, in certain embodiments, the second reflecting surface 350*b* may be inclined at a predefined angle such that a greater amount of light may be reflected back toward the center of light exit surface 210 of the lens 200. Hence, light loss near the window region 240 may be corrected and light distributing efficiency may be improved.

Moreover, as shown in FIG. 6, the coupling flange 260 of the lens 200 may be placed on the seating recess 660 of the heat sink 600 and the coupling surface 370 of the reflector 300. The cover-ring 100 may be placed on the lens 200 and the heat sink 600 such that coupling recess 160 on the cover-ring 100 is placed on the coupling flange 260. A height of the seating recess 660 and the coupling recess 160 may be formed to correspond to the thickness of the coupling flange 260 such that the lens 200 may be secured on the heat sink 600.

Figure 7:
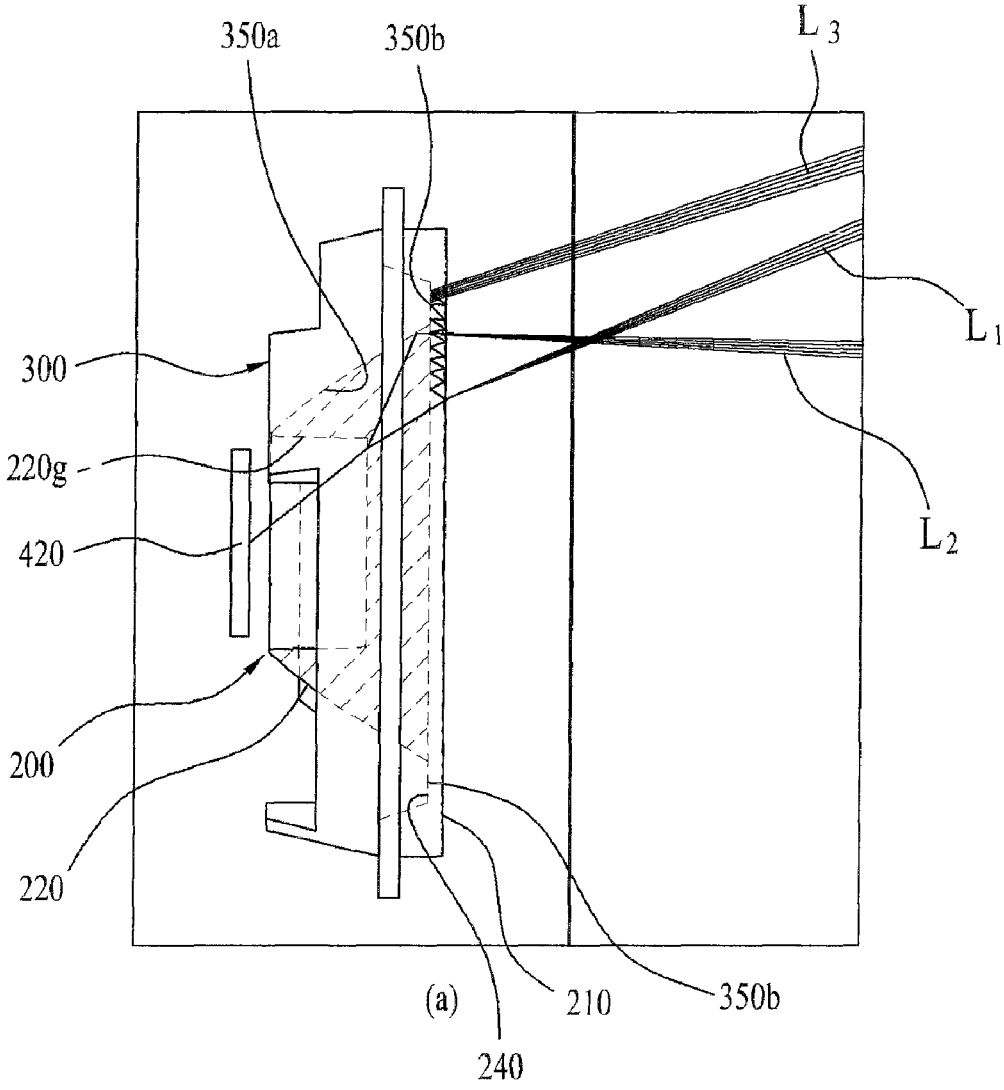
FIG. 7 illustrates a reflection of light in the lighting device according to an embodiment of the present disclosure.

FIG. 7 illustrates a reflection of light in the lighting device according to the present disclosure. In FIG. 7, three exemplary paths L1, L2, L3 in which light may travel through the lighting device 1000 is illustrated. As previously described, the lighting device 1000 may include an LED 420, a lens 200, and a reflector 300 having a first and second reflecting surfaces 350*a*, 350*b*. The first reflecting surface 350*a* of the reflector 300 may be inclined at a predetermined angle corresponding to an angle of incline of the sloped side surface 220*s* of the condensing lens 220. The second reflecting surface 350*b* may be extended to contact the window region 240 of the lens 200.

Light emitted from the LED 420 may be projected into recess 220*g* of the condensing lens 220. The surface of the lens 200 inside the recess 220*g* may refract the light into three different paths L1, L2, and L3. In the first light path L1, the light incident on a surface of the recess 220*g* of the condensing lens 220 may be directed towards the light exit surface 210 to be emitted in a predefined direction.

In the second light path L2, a portion of light incident on the surface of the recess 220*g* may be refracted towards the sloped side surface 220*s* of the condensing lens 220. Because the first reflecting surface 350*a* may be positioned adjacent to the sloped side surface 220*s*, the light in the second path L2 may be reflected by the reflector 300 toward the light exit surface 210 to be emitted in a predefined direction.

In the third light path L3, a portion of light in the first path L1 may fail to exit the lens and may be reflected by the light exit surface 210 back into the lens 200. In the third light path L3, light may be reflected and scattered inside the lens 200 toward the window region 240. However, because the second reflecting surface 350*b* may be positioned adjacent to the window region 240, light in the third path L3 may be prevented from escaping the lighting device 1000 and may be reflected back towards the light exit surface 210 by the second reflecting surface 350*b*. The light may then be emitted in a predefined direction.

Accordingly, because the reflector 300 may include the first and second reflecting surfaces 350*a*, 350*b* which are formed to correspond to a shape of the sloped side surface 220*s* of the condensing lens 220 as well as the window region 240, light refracted or scattered at a surface of the lens 200 may be reflected back towards the lens 200. Accordingly, light loss in the lighting device 1000 may be minimized and the light distribution efficiency may be maximized.

A lighting device is embodied and broadly described herein. The lighting device may include a light emitting element; a light emitting module having the light emitting element mounted thereon; a heat sink including a securing space to secure the light emitting module therein; and a lens member provided in an upper portion of the light emitting module. The lens member may include a condensing lens projected toward the light emitting module from a center portion thereof, with a predetermined sloped side having a predetermined inclination. Moreover, the lighting device may also include a reflecting member secured in the securing space to surround a circumference of the slope side of the condensing lens. The reflecting member may include a first reflecting side configured to surround the slope side of the condensing lens and a second reflecting side having a predetermined inclination different from an inclination of the first reflecting side.

The lens member may include a window part provided around a circumference of the condensing lens. Moreover, the second reflecting side may be extended to the window part. The second reflecting side may be in area-contact with the window part. An inclination of the slope side of the condensing lens may correspond to an inclination of the first reflecting side of the reflecting member. The first reflecting side of the reflecting member and the slope side of the condensing lens may be integrally connected with each other, in contact with each other. Furthermore, an angle formed between the first reflecting side and the second reflecting side may be 90° or more.

The lighting device may further include a cover-ring configured to secure the lens member to the heat sink, wherein a securing flange is tightly secured to a circumference of the window part of the lens member by the cover-ring. The securing flange may include a step stepped toward the projecting direction of the condensing lens, in parallel to the window part. The reflecting member may include a hooking protrusion in area-contact with the securing flange, the hooking protrusion having a step formed in a circumference of the second reflecting side. Moreover, a lens array may be provided in a light emitting side which is a front surface of the lens member.

In another aspect of the present disclosure, a lighting device as embodied and broadly described herein may include a light emitting module having a light emitting element mounted thereon; a heat sink comprising a recessed portion to seat the light emitting module therein; a lens member comprising a condensing lens projected toward the light emitting module and a securing flange having a step formed in a circumference thereof; a reflecting member configured to surround an outer surface of the condensing lens provided in the lens member, the reflecting member having a step integrally connected with the securing flange of the lens member; and a cover-ring configured to support the securing flange of the lens member, the cover-ring connected to the heat sink.

The lens member may include a level window part provided in a circumference of the condensing lens. The reflecting member may be extended to the window part. The reflecting member which is extended to the window part may be in area-contact with a back surface of the window part. Moreover, the cover-ring may be coupled to the heat sink by a coupling member from a backward direction. In this embodiment, an inclination of an outer surface of the condensing lens may be corresponding to an inclination of an inner surface of the reflecting member.

In a further aspect of the present disclosure, a lighting device as embodied and broadly described herein may include a light emitting module having a light emitting element mounted thereon; a heat sink configured to radiate heat conducted from the light emitting module, the heat sink having the light emitting module mounted thereto; a lens member configured to collect lights emitted from the light emitting element and to project the lights with a predetermined directionality; and a reflecting member configured to re-reflect lights scattered or reflected in the lens member.

The lens member may include a condensing lens projected toward the light emitting module to collect the lights emitted from the light emitting element and a level window part provided around the condensing lens. The reflecting member may reflect the scattered or reflected lights toward a back surface of the lens member from the window part of the condensing lens in a forward direction of the lens member, in close contact with an outer surface of the condensing lens and the window part of the condensing lens to reflect the scattered light. In this embodiment, a back surface of the lens member and a front surface of the reflecting member may be integrally connected with each other.

According to the present disclosure, a plurality of the light emitting elements may be provided such that a sufficient amount of light may be provided. In addition, together with the plurality of the light emitting elements, the reflecting member may be provided. The reflecting member may be configured to efficiently reflect the lights emitted from the light emitting elements such that light distribution efficiency may be maximized. Furthermore, in the lighting device as disclosed herein, the part location determining function may be stabilized between the parts. As a result, usage of coupling members used to couple the parts to each other may be minimized and assembly efficiency may be improved.

A lighting device is embodied and broadly described herein. The lighting device as disclosed herein may include an LED module configured to emit light; a housing to house the LED module; a reflector provided on the LED module; and a lens provided on the reflector and configured to direct light in a first direction, the lens including an inclined surface at a first angle relative to the first direction. The reflector may include a first reflecting surface and a second reflecting surface, the first reflecting surface being inclined at the first angle and the second reflecting surface being inclined at a second angle that is different from the first angle, and wherein the second reflecting surface of the reflector is adjacent to the lens.

The inclined surface of the lens may be positioned adjacent to the first reflecting surface of the reflector and the second angle may be greater than the first angle. Moreover, the lens may include a collecting lens formed to protrude toward the LED module, wherein the inclined surface of the lens may be an outer surface of the collecting lens.

In the lighting device of this embodiment, the lens may include a recess on a surface adjacent to the collecting lens configured to receive the second reflecting surface of the reflector. Here, a surface inside the recess may be inclined at the second angle and positioned adjacent to the second reflecting surface. Moreover, the recess may be provided around a circumference of the collecting lens and the second reflecting surface may extend to a surface inside the recess, wherein the surface inside the recess may be inclined at the second angle and positioned adjacent to the second reflecting surface.

The reflector may include a seating surface that protrudes from an outer circumferential surface of the reflector and configured to correspond to a flange formed around an outer circumference of the lens. The lens may be seated on the seating surface on the reflector. The lens may includes a flange provided adjacent to the recess. The flange may be positioned a prescribed height below an exit surface of the lens and may be formed to extend outward from an outer circumferential surface of the lens.

The lighting device of this embodiment may further include a cover-ring provided on the flange that couples the lens to the housing, wherein a bottom surface of the cover-ring includes a recess formed to correspond to the flange. Moreover, the reflector may include a step provided around a circumference of the second reflecting surface which may be formed to correspond to the flange. In the lighting device of this embodiment, an exit surface of the lens includes a micro lens array. Moreover, wherein the housing is a heat sink.

In another embodiment, a lighting device may include a light emitting module having one or more light emitting elements mounted thereon; a heat sink including a recessed portion, wherein the light emitting module is provided in the recessed portion; a lens including a collecting lens that protrudes toward the light emitting module and a securing flange formed around a circumference of the lens; a reflector provided between the light emitting module and the lens, wherein a surface of the reflector is shaped to correspond to a shape of the collecting lens, the reflector having a recess that corresponds to the securing flange of the lens; and a cover-ring provided over the securing flange of the lens to couple the lens to the heat sink.

In this embodiment, the lens may include a flat surface provided around a circumference of the collecting lens, wherein the reflector may include a flat reflecting surface that extends to the flat surface on the lens, the flat reflecting surface being inclined at a prescribed angle. The flat reflecting surface may be positioned adjacent to the flat surface on the lens to make direct contact therewith. The cover-ring may be coupled to the heat sink by a connector inserted through the heat sink into the cover-ring. Moreover, an outer surface of the collecting lens may be inclined at a prescribed angle, wherein the surface of the reflector may be inclined at the prescribed angle that corresponds to the outer surface of the collecting lens.

Examples of a lighting apparatus are disclosed in application Ser. No. 13/049,771 and application Ser. No. 13/049,776, which is hereby incorporated by reference.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting device comprising:

an LED module configured to emit light;

a housing to house the LED module;

a reflector positioned over the LED module; and a lens positioned over the reflector and configured to direct light in a first direction, the lens including an inclined surface at a first angle relative to the first direction, wherein the reflector includes a first reflecting surface and a second reflecting surface, the first reflecting surface being inclined at the first angle and the second reflecting surface being inclined at a second angle that is greater than the first angle relative to the first direction, and wherein the second reflecting surface of the reflector is adjacent to the lens.

2. The lighting device of claim 1, wherein the inclined surface of the lens is positioned adjacent to the first reflecting surface of the reflector.

3. The lighting device of claim 1, wherein the second angle is greater than the first angle.

4. The lighting device of claim 1, wherein the lens includes a collecting lens formed to protrude toward the LED module, and wherein the inclined surface of the lens is an outer surface of the collecting lens.

5. The lighting device of claim 4, wherein the lens includes a recess on a surface adjacent to the collecting lens configured to receive the second reflecting surface of the reflector.

6. The lighting device of claim 5, wherein a surface inside the recess is inclined at the second angle and positioned adjacent to the second reflecting surface.

7. The lighting device of claim 5, wherein the recess is provided around a circumference of the collecting lens and the second reflecting surface extends to a surface inside the recess.

8. The lighting device of claim 7, wherein the surface inside the recess is inclined at the second angle and positioned adjacent to the second reflecting surface.

9. The lighting device of claim 5, wherein the reflector includes a sealing surface that protrudes from an outer circumferential surface of the reflector and configured to correspond to a flange formed around an outer circumference of the lens, wherein the lens is seated on the sealing surface on the reflector.

10. The lighting device of claim 4, wherein the lens includes a flange provided adjacent to the recess.

11. The lighting device of claim 10, wherein the flange is positioned a prescribed height below an exit surface of the lens and formed to extend outward from an outer circumferential surface of the lens.

12. The lighting device of claim 10, further comprising:

a cover-ring provided on the flange that couples the lens to the housing, wherein a bottom surface of the cover-ring includes a recess formed to correspond to the flange.

13. The lighting device of claim 10, wherein the reflector includes a step provided around a circumference of the second reflecting surface and formed to correspond to the flange.

14. The lighting device of claim 1, wherein an exit surface of the lens includes a micro lens array.

15. The lighting device of claim 1, wherein the housing is a heat sink.

16. A lighting device comprising:

a light emitting module having one or more light emitting elements mounted thereon;

a heat sink including a recessed portion, wherein the light emitting module is provided in the recessed portion;

a lens including a collecting lens that protrudes toward the light emitting module and a planar surface that extends radially outward around a circumference of the lens;

a reflector provided over the light emitting module and positioned between the light emitting module and the lens, wherein a surface of the reflector is shaped to correspond to a shape of the collecting lens and the planar surface and positioned a prescribed distance from the collecting lens, the reflector having a recess that corresponds to the planar surface of the lens; and a cover-ring provided over the lens to couple the lens and the reflector to the heat sink.

17. The lighting device of claim 16, wherein the lens includes a flat surface provided around a circumference of the collecting lens, and wherein the reflector includes a flat reflecting surface that extends to the flat surface on the lens, the flat reflecting surface being inclined at a prescribed angle.

18. The lighting device of claim 16, wherein the flat reflecting surface is positioned adjacent to the flat surface on the lens to make direct contact therewith.

19. The lighting device of claim 16, wherein an outer surface of the collecting lens is inclined at a prescribed angle, and wherein the surface of the reflector is inclined at the prescribed angle that corresponds to the outer surface of the collecting lens.

20. A lighting device comprising:

an LED module configured to emit light;

a housing to house the LED module;

a reflector positioned over the LED module; and a lens positioned over the reflector and configured to direct light in a first direction, the lens including a condensing lens having an inclined surface at a first angle relative to the first direction, wherein the reflector includes a first reflecting surface and a second reflecting surface, the first reflecting surface being inclined at the first angle and the second reflecting surface being inclined at a second angle that is greater than the first angle relative to the first direction, and wherein the lens includes a flange provided around a circumference of the condensing lens and having a recess formed on the flange, the recess configured to receive the second reflecting surface of the reflector such that the second reflecting surface makes contact with a surface inside the recess of the lens.

* * * * *